US005806472A

United States Patent [19]

Nelson et al.

[11] Patent Number: 5,806,472

[45] Date of Patent: Sep. 15, 1998

[54] METHOD AND MEANS FOR REMOVAL OF USED OIL AND BLENDING WITH FUEL FOR DISPOSAL IN AN ENGINE

[75] Inventors: Robert M. Nelson, Rosamond, Calif.; Robert E. Nelson, 4040 Manly Rd., Rosamond, Calif. 93560

[73] Assignee: Robert E. Nelson, Rosamond, Calif.

[21] Appl. No.: 561,187

[22] Filed: Nov. 21, 1995

[51] Int. Cl.[6] ..... F01M 11/06

[52] U.S. Cl. ..... 123/73 AD; 123/196 S

[58] Field of Search ..... 123/196 S, 73 AD; 184/1.5

[56] References Cited

U.S. PATENT DOCUMENTS

| | | | |
|---|---|---|---|
| 4,376,449 | 3/1983 | Nelson et al. | 137/391 |
| 4,417,561 | 11/1983 | Yasuhara | 123/196 S |
| 4,421,078 | 12/1983 | Hurner | 123/196 S |
| 4,747,300 | 5/1988 | Nelson et al. | 137/391 |
| 4,869,346 | 9/1989 | Nelson | 123/196 S |
| 4,989,560 | 2/1991 | Rasdal et al. | 123/196 S |
| 5,238,085 | 8/1993 | Engelmann | 123/196 S |
| 5,353,760 | 10/1994 | Zager | 123/196 S |
| 5,390,762 | 2/1995 | Nelson | 123/196 S |
| 5,431,138 | 7/1995 | Hurner | 123/196 S |
| 5,526,783 | 6/1996 | Ito et al. | 123/196 S |

*Primary Examiner*—Erick R. Solis
*Attorney, Agent, or Firm*—Donald D. Mon

[57] ABSTRACT

An electrically driven metering pump removes used oil in precise increments at a controllable rate of repetition from a safe operating level in the sump or reservoir of an engine, compressor, transmission or other power equipment; preferably in combination with means provided by a circulating oil supply system, in which withdrawal of oil from the sump is at a controlled running level and oil for removal is taken from a withdrawal path in the supply system, using a separator to exclude air from the oil removed. Oil removed by the metering pump is filtered and delivered to an electrically driven blending pump, which draws in engine fuel for combination with this oil by turbulence, repetitive transfer, heating and forced dispersion to produce a primary blend at a composition determined by the relative volumes of delivery per operating pulse and the relative rates of pulse repetition of the metering and blending pumps. The primary blend is then delivered to an engine fuel system, where it is mixed with more fuel to produce a final blend for disposal by burning in an engine. Removal of used oil may be suspended or modified in rate in response to one or more operating variables, including demand, idling condition, speed, load, fuel consumption or level of fuel in a tank.

6 Claims, 4 Drawing Sheets

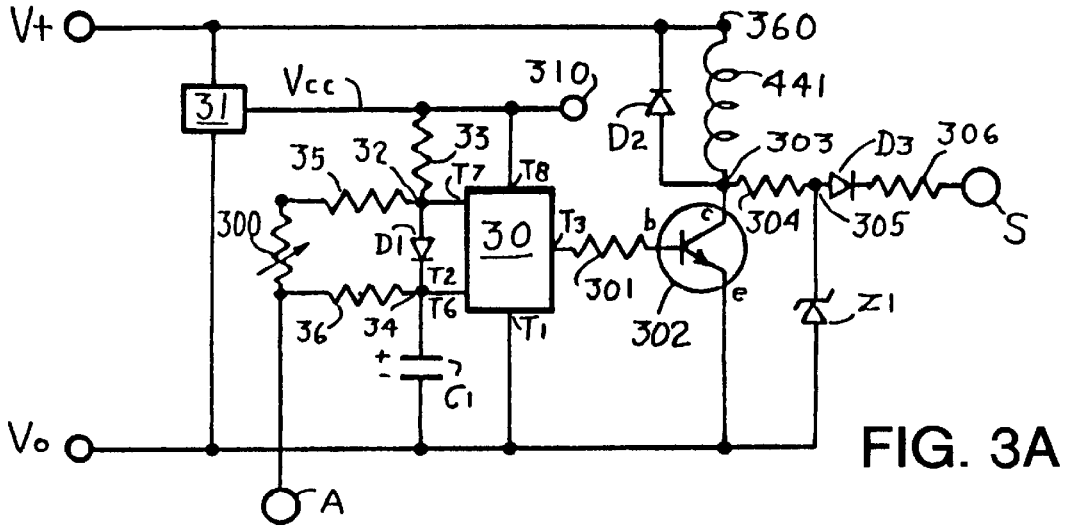
FIG. 3A
FIG. 3B
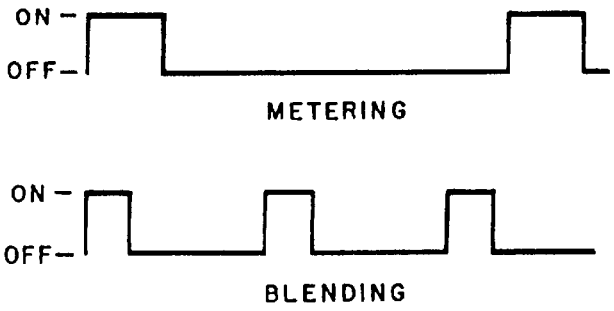
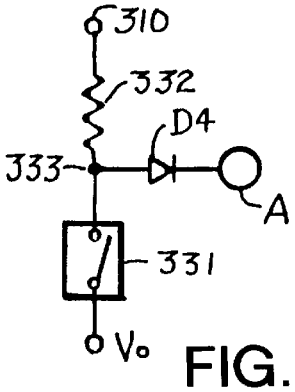
FIG. 3C
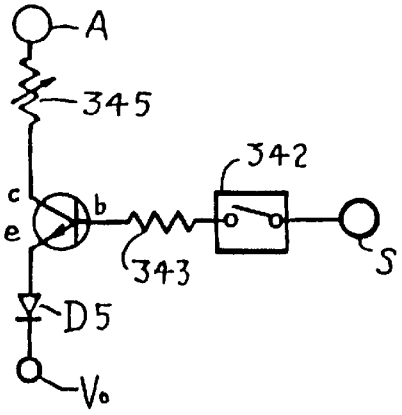
FIG. 3D
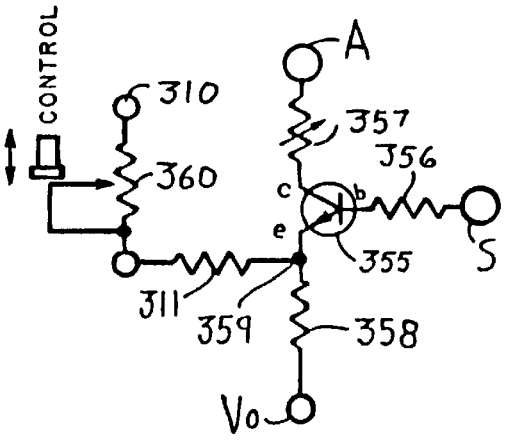
FIG. 3E

METHOD AND MEANS FOR REMOVAL OF USED OIL AND BLENDING WITH FUEL FOR DISPOSAL IN AN ENGINE

FIELD OF THE INVENTION

This invention relates to the removal of used lubricating oil in an engine, compressor, or other power equipment and to the disposal of oil so removed by combining with fuel and burning in an engine.

BACKGROUND OF THE INVENTION

Systems for disposal of used oil drained from engines and other power equipment by bulk blending with fuel and burning in an engine have been used for many years. Such systems are open to misuse, in that contaminants from the oil may not be kept out of the blended fuel, that blending may not be complete and that the concentration of oil in the blend may not be well controlled. These systems require handling of used oil and time and attention in changing of oil, blending and storage.

On-board systems for removal and disposal of used oil have been applied directly to engines. Some systems draw oil for removal from the pressure system and risk depletion of oil in the engine in the event of a malfunction. We avoid this problem by drawing for removal only oil which originates in the engine sump at a level high enough for safe operation; preferably from a running level determined by automatic means for replenishment. Oil is not taken when the running level is lower.

In some systems unblended oil is sent to a fuel tank, either directly or through a return line from an engine, in the hope that this oil will blend with fuel. If this does not occur, unblended or partially blended oil may accumulate in the fuel tank and may be delivered to an engine. In engines not adapted to burn such oil, this may result in incomplete combustion, smoking in the exhaust and damage to the engine.

In this invention we meter the removal of used oil and combine this oil with fuel in a blending pump by turbulence, heating and forced dispersion of oil to produce a primary blend which is thereafter mixed with additional fuel to produce a final blend suitable for consumption by an engine. We control the relative rates of delivery of metering and blending pumps and thereby the proportion of fuel to oil in the primary blend; both to promote blending and to insure that the primary blend will be sufficient in fuel content for later mixing with additional fuel.

In order to avoid excessive concentration of oil in the final blend delivered to an engine for consumption, we may choose to suspend or to modify automatically, during operation of the equipment served or of the engine in which blended fuel is consumed, the rate of removal of oil in response to one or more operating variables, such as idling condition, demand, speed, load, fuel pressure or rate of fuel consumption. We may also choose to modify or terminate removal of oil as the level of fuel in a tank goes down and concentration of oil in the fuel increases.

Means to be disclosed for removal and metering of used oil from an engine are capable of independent use. However, we have found it advantageous to combine means for removal of used oil with means provided by a circulating oil supply system, both for convenience and because this method prevents removal when the running oil level is below a preset level in a sump.

COMBINATION WITH A CIRCULATING OIL SUPPLY SYSTEM

A circulating oil supply system suited to this purpose is disclosed in our U.S. Pat. Nos. 4,376,449 and 4,747,300, the disclosures of which we incorporate herein by reference.

Circulating supply systems of this type maintain a body of oil in the sump of an engine or other power equipment from a separate supply tank or container and combine the oil in both by circulation through lines between them.

The supply tank acts as a reservoir of oil to replace oil removed or consumed; and either as a source of supply or as a receiver of oil as may be necessary to maintain a correct level of oil in the sump during operation.

In a circulating system as disclosed in the above-referenced patents, a first pump delivers oil through a withdrawal path which originates in the sump at a preset level and ends at a supply tank.

When oil is above the preset level in the sump it is drawn down until that level is reached and air is drawn. When this air reaches the first pump a signal is generated to activate a second pump, which delivers oil in a return path from the tank back to the sump until air is no longer drawn by the first pump. The system alternates between withdrawal and return of oil and holds the running level of oil in the sump with little variation.

Used oil may be removed for disposal from any point in a circulating system because of continuous mixing of sump and tank oil, which tends to equalize the quality of oil in both. However, we generally prefer to remove oil from the withdrawal path of the first pump, which draws oil from the sump, rather than from the tank or the return path from the tank, because oil in the withdrawal path will generally have the highest proportion of used rather than new oil, especially after servicing. Taking oil from the withdrawal path for removal also permits a check on functioning of a circulating system in maintaining the level of oil in the equipment, because used oil cannot be removed unless a preset running level is maintained. In a planned pattern of operation and servicing, the amount of oil required to replenish the system in servicing becomes a check on operation of the system.

Although the method and means of this invention will be shown and described primarily with reference to engines, our invention is applicable to other power equipment, including compressors, engine-compressors and transmissions, in which continuous removal and replacement of oil may be of value.

BRIEF DESCRIPTION OF THE INVENTION

An electrically driven metering pump removes used oil in precise increments at an adjustable rate of repetition from a safe operating level in the sump or reservoir of an engine, compressor, or other power equipment; either directly or in combination with replenishment means such as those provided by a circulating oil supply system, in which withdrawal of oil from the sump is at a controlled running level and oil for removal is taken from the withdrawal path of the supply system, using a separator to exclude air from the oil removed.

Oil removed by the metering pump is filtered and delivered to an electrically driven blending pump, where it is combined with an amount of engine fuel determined by the relative rates of delivery of the metering and blending pumps. Turbulence, heating and forced dispersion of oil into the fuel produce a primary blend which is thereafter mixed with additional fuel to produce a final blend for disposal in an engine. To insure removal of used oil in amounts appropriate to conditions of operation of the equipment served and to control concentration of oil in the final blend, removal of used oil may be suspended or modified in rate in response to one or more operating variables, including demand, idling condition, speed, load, fuel consumption or fuel remaining in a tank.

BRIEF DESCRIPTION OF THE DRAWINGS

FIG. 3A shows in diagram a basic electronic circuit which powers and controls the operation of the metering and blending pumps M and B of FIGS. 1 and 2.

FIG. 3B shows graphically typical cycles of pulsed operation of the metering and blending pumps M and B, as controlled by the circuit of FIG. 3-1.

FIGS. 3C, 3D and 3E show typical circuits which modify or suspend operation of the basic circuit of FIG. 3-1.

DETAILED DESCRIPTION OF THE INVENTION

The circulating system

Figure 1:
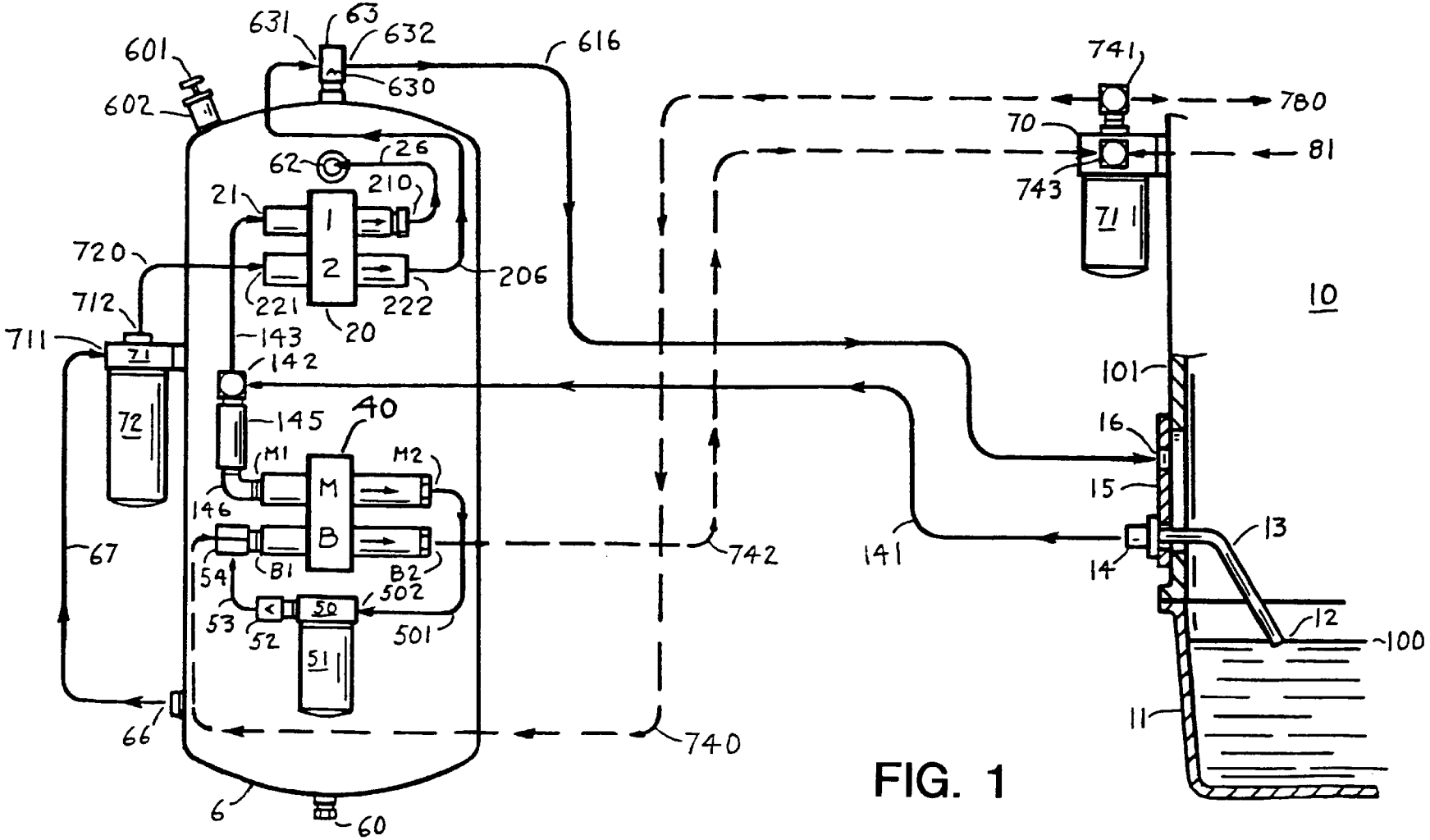
FIG. 1 shows in diagram a circulating oil supply system incorporating means for used oil removal, metering, primary oil/fuel blending and delivery to the fuel system of an engine for final blending and consumption.

FIG. 1 shows in diagram a circulating oil supply system as applied to an engine, with added components required for the controlled removal of used oil, primary blending with fuel, mixing with additional fuel and delivery for consumption by the engine.

The system of FIG. 1 employs two electrically driven pumps in a single pumping unit 20; Pump 1, which runs continuously and transfers oil or air from the engine sump 11 to reserve supply tank or reservoir 6, depending upon the running level of oil in the sump; and Pump 2, which returns oil from tank 6 to the sump, the operation of which is controlled by Pump 1.

Pump 1 draws from sump 11 at control level 100, which is the installed level of the open end 12 of withdrawal tube 13. This tube is carried by sump adapter 14, which permits entry of the withdrawal tube 13 through an inspection plate 15 on crankcase 101. Delivery from sump adapter 14 passes through line 141 to the junction 142 between line 141, line 143 to the intake 21 of Pump 1 and to separator 145. The greater part of the oil and all of the air which enters junction 142 is delivered to Pump 1 at its intake 21. This pump delivers through its outlet 210 to line 26, which delivers to tank 6 through port 62.

When the running level of oil in the sump 11 is above control level 100, oil is drawn by pump 1 and the running level goes down until the control level is reached; after which air is drawn. When this air reaches Pump 1 an air sensing signal is generated and Pump 2 is activated. Pump 2 draws oil from tank 6 at port 66, through line 67 to port 711 in filter adapter 71, through oil system filter 72, outlet 712 and line 720 to inlet port 221 of Pump 2 in pumping unit 20; passing through Pump 2 to outlet 222, line 206 and inlet port 631 of air relief valve 63, through outlet port 632 to line 616 and thereafter to port 16 in plate 15 on the side of crankcase 101 and to sump 11.

Air relief valve 63 incorporates check valve 630, the purpose of which is to vent air received at tank 6 from Pump 1. This air returns with oil from Pump 2 through line 616 to a return port 16 on plate 15.

Tank 6 may be serviced with new oil by removing closure 601 from filler neck 602 and may be drained through bottom port 60.

To this point our description has been of a circulating oil supply system only, except for the connection of line 141 to junction 142. In the absence of a metering and blending system, line 141 would be routed directly to the inlet 21 of Pump 1 and neither junction 142 nor separator 145 would be used.

Metering and blending

Separator 145 receives oil from junction 142 as already described and rejects air, which is delivered to Pump 1 through line 143 with oil not taken by separator 145. Separator 145 also serves as an accumulator of used oil for metering. Oil from separator 145 passes through elbow fitting 146 and into the intake M1 of metering pump M, which is incorporated into metering and blending unit 40. This pump, to be described more fully later, delivers used oil in timed and measured increments at its exit M2 and through line 501 to the inlet 502 of filter mounting head 50, which delivers to and carries filter 51.

Filter 51 removes particulates originating in the engine 10 from the used oil passing through it and is for the protection of fuel system components of the engine in which this oil will later be consumed in blended form.

Oil leaving filter head 50 passes through loaded check valve 52, the purpose of which is to prevent entry of air when filter 51 is removed for changing during operation, and which may be loaded to a pressure drop of approximately one atmosphere. Check valve 52 delivers oil through line 53 to junction fitting 54 and to blending pump B at B1.

Junction fitting 54 also receives engine fuel through line 740 from junction fitting 741 at the outlet of engine fuel filter head 70, drawn by blending pump B, which blends this fuel with oil received from metering pump M to create a primary blend containing a limited proportion of fuel. This blend is then delivered through line 742 to inlet junction fitting 743 of fuel filter head 70, where it combines with fuel received from an engine fuel tank 80 (not shown in this Figure) through line 81.

The simultaneous introduction into the fuel filter 71 of the primary blend of oil and fuel from the blending pump B and incoming fuel from the fuel tank through line 81 results in a final blend at a reduced oil concentration for delivery through line 780 to the engine for consumption. Final mixing of the primary blend with fuel occurs in the junction fitting 743 and within filter head 70 and filter 71.

Direct removal from a sump

Figure 2:
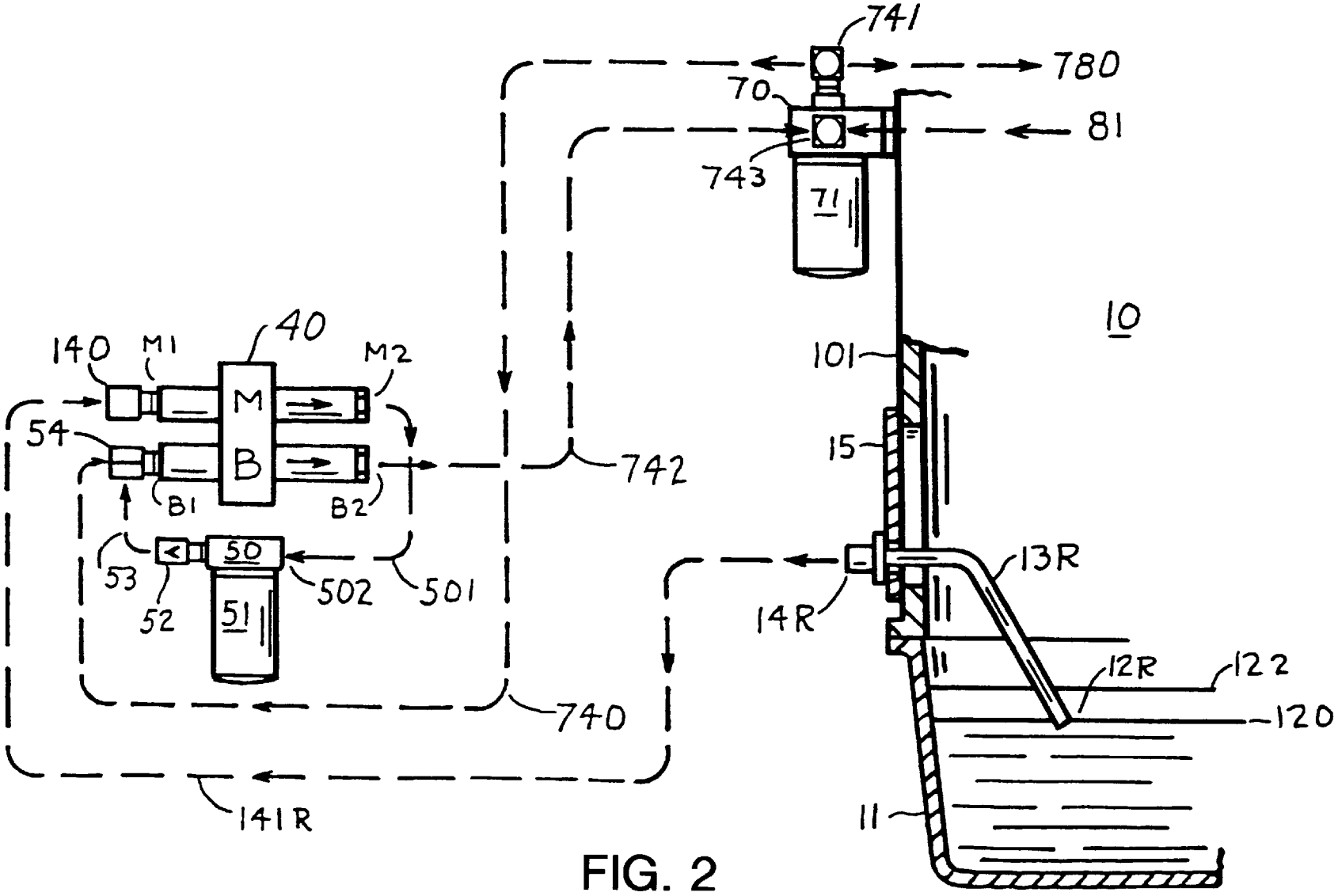
FIG. 2 shows in diagram an alternative oil removal and oil/fuel blending system with means for direct removal of oil from the sump, in which a circulating oil supply system is not used.

FIG. 2 shows an oil removal, metering and blending system which takes used oil directly from the sump of the engine or other power equipment served.

Instead of receiving oil from the withdrawal line 141 of a circulating system at junction 142 as in FIG. 1, metering pump M draws oil through in-line screen 140 and line 141R from sump adapter 14R, which incorporates a tube 13R having an open end 12R at draft level 120. For removal to be effective under all conditions of operation, the draft level must not be above the lowest running level 122 of oil in the engine, whether serviced manually or maintained by automatic oil supply means; but must be high enough to avoid depletion of the sump in the event that the supply of oil is not replenished when needed.

The remaining system components, including the metering and blending unit 40, filter 51, filter 71 and fuel connections are equivalent to those of FIG. 1.

Power and control

In our U.S. Pat. No. 4,376,449, to which reference has already been made, we show and describe circuits which are equivalent to those used to control the operation of circulating system pumps 1 and 2 of unit 20, shown in FIG. 1. The metering and blending pumps M and B of this invention operate under the control of circuits employing similar elements. We show in FIG. 3-1 the basic circuit which is used for pumps M and B.

In FIG. 3-1, power from a DC source at an optional working voltage, commonly 12 or 24 volts, is supplied at terminals V+ and $V_0$ (negative). Voltage regulator 31 supplies positive control voltage $V_{cc}$ to external terminal 310 and to terminal T8 of a 555 timer 30, which connects to $V_0$ through terminal T1. Terminal T7 connects with junction 32. Resistor 33 controls current through terminal 32, diode D1 and terminal 34, which connects to terminals T2 and T6 of timer 30 and to the positive side of capacitor C1. This current charges capacitor C1, which affects both ON and OFF times of timer 30. Variable resistor 300, in series with resistors 35 and 36 between terminals 32 and 34, adjusts the discharge current of capacitor C1 through terminal T7 of timer 30 and thereby the OFF time of timer 30. This is the adjustment which determines the rate of repetition of the operating cycle of metering pump M.

Figure 4:
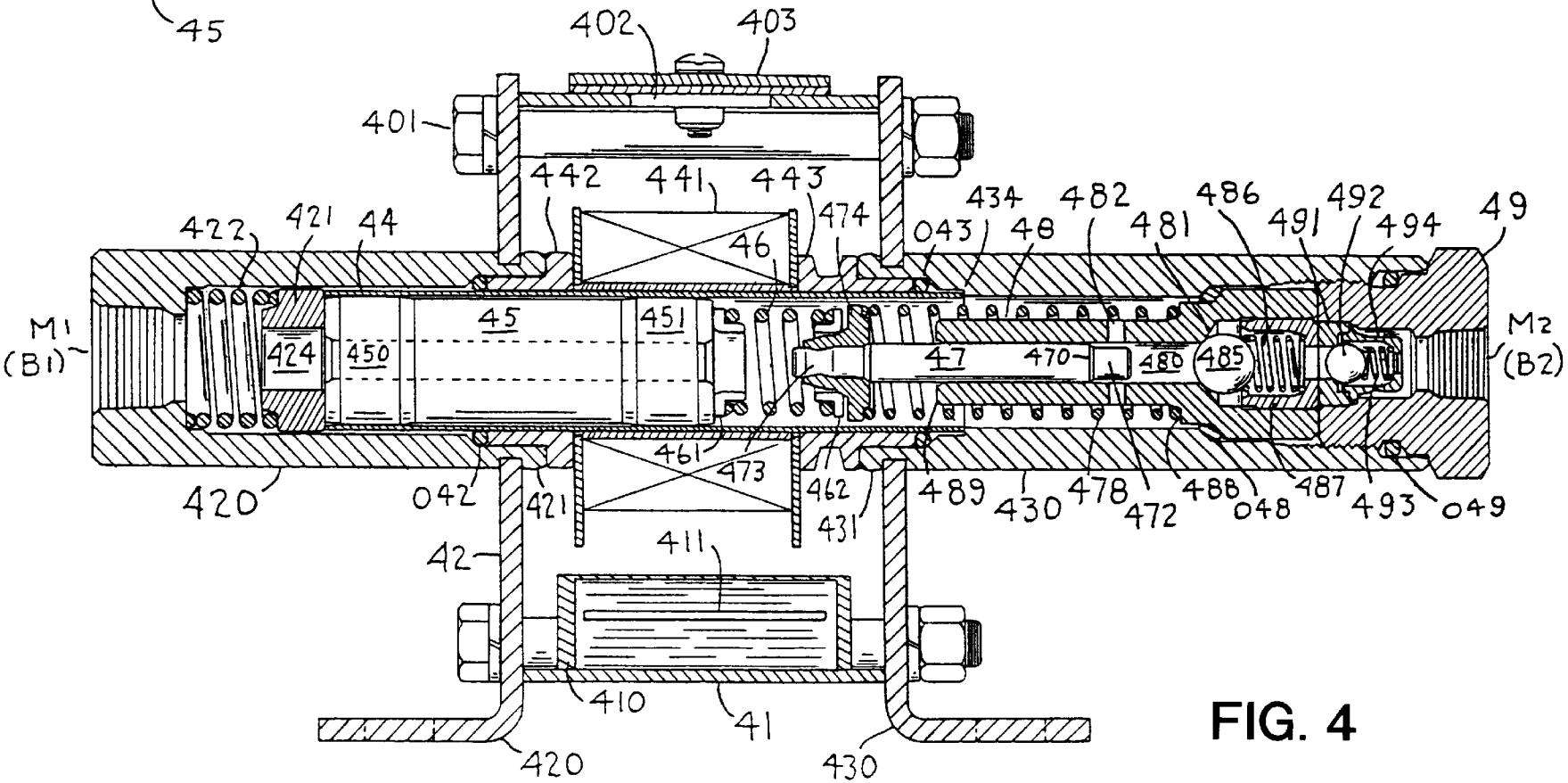
FIG. 4 is a sectional view taken through the metering pump M of unit 40 of FIGS. 1 and 2. Blending pump B is equivalent in section, except for dimensions and the optional addition of orifice means as shown in FIG. 4B.

Output terminal T3 of timer 30 delivers through resistor 301 to base b of NPN power transistor 302 (Darlington), the emitter e of which connects to $V_0$ and collector c to junction 303, which powers coil 441 of metering pump M or blending pump B (FIG. 4). Coil 441 connects at its opposite end with V+ at terminal 360. Clamping diode D2 across coil 441 suppresses spikes at turnoff.

Terminal 303 also delivers through resistor 304 and terminal 305, which delivers through diode D3 and resistor 306 to signal output terminal S, which is available to supply an operating signal and provide a logic output for additional control circuits to be shown. Zener diode Z1 connects between terminal 305 and $V_0$ to limit the signal voltage at terminal S.

Basic cycles of operation

Typical cycles of operation of metering and blending pumps M and B, under control of basic circuits as in FIG. 3-1, are shown graphically in FIG. 3-2, which gives for both pumps operating pulses on the same time scale.

The ON time of the metering pump as determined by resistor 33 is normally fixed at a value appropriate for operation of this pump under the least favorable condition of external temperature and the highest viscosity of the used oil to be metered. When it is desired to make this time adjustable, a variable resistor may replace fixed resistor 33. The basic rate of repetition of metering pump M in this circuit may be adjusted by means of variable resistor 300. This adjustment, which determines the OFF time of metering pump M, is usually based on an hourly or daily planned oil removal appropriate to the engine or other equipment served.

Because the blending pump cycle is normally predetermined, variable resistor 300 is usually replaced in this circuit as applied to blending pump B with one of fixed value. On the same time scale as that of the metering pump, both ON and OFF times of the blending pump are shorter. This results in a faster rate of repetition which, in conjunction with the greater delivery of the blending pump per stroke, gives a substantially greater rate of delivery of blending pump B than of metering pump M. This gives a pumping capacity of blending pump B sufficient to draw fuel in the amounts needed for primary blending.

Control of metering

As already shown, the rate of repetition of the metering pump may be adjusted by means of the variable resistor 300 of FIG. 3-1. In the same Figure, terminals are shown which provide for optional connection to external circuits which may suspend metering or modify its rate in response to varying conditions of operation of an engine or other equipment served, or of an engine in which a blend of oil and fuel is consumed, or both. These include terminal A, which provides a common input from such circuits; terminals V+ and 310, which provide sources of stable positive voltage; the $V_0$ terminal; and terminal S, which provides a cycle-based reference voltage for other control circuits and may be used to power a signal which indicates the ON or OFF condition of the circuit of FIG. 3-1.

We will show several circuits which may be used to suspend operation of the metering pump or modify its rate in response to variables in the operation of the engine or other equipment served, to be described with reference to an engine. These circuits are illustrative of a range of methods which may be employed to control the operation of the metering pump M.

In FIG. 3—3 we show a circuit for the purpose of suspending operation of the metering pump M under a low power or idling condition. In this circuit switch 331 could be responsive to functions such as fuel or rail pressure, oil pressure, engine speed, mechanical or electrical power output, rate of fuel consumption, level of fuel remaining in a tank or position of a control. In the following example, fuel or rail pressure will be taken as the operative variable, as used in a PT fuel system applied to a Cummins engine.

In a circuit to respond to rail pressure, a source of positive voltage such as $V_{cc}$ (310) connects through a resistor 332 with junction 333, which connects through diode D4 to terminal A of FIG. 3-1. When pressure switch 331 is open, a positive blocking voltage input to terminal A holds the control voltage of capacitor C1 and of timer input terminals T2 and T6 above the level required to begin an ON period of metering pump M and thereby prevents metering. This is a condition appropriate to operation during idling or at low power, when rail pressure is insufficient to close pressure switch 331, and is useful as a means for preventing metering and delivery of used oil to the fuel system at a time when delivery at a normal rate would result in an excessive concentration of oil in the fuel.

In this application switch 331 is preadjusted to a closing pressure above which metering at a normal rate is intended, as during operation within a normal range of power. With increasing pressure switch 331 closes, connecting junction 333 to $V_0$. This prevents injection of positive blocking voltage at terminal A and permits normal operation of metering pump M.

FIG. 3-4 shows a circuit in which a pressure switch 342, equivalent to switch 331 of FIG. 3—3, operates at a similar closing pressure, but permits two separately controllable levels of metering. The emitter e of NPN signal transistor 344 sinks to $V_0$ through diode D5; while the collector c connects to terminal A through a variable resistor 345. At low power, when switch 342 is open, the base b of transistor 344 is not driven and transistor 344 isolates terminal A; so that the circuit of FIG. 3-1 operates normally. Under this condition variable resistor 300 is in control of metering under low power and can be adjusted to permit delivery at a rate appropriate to low power operation.

Voltage at signal terminal S is high when the circuit of FIG. 1 is in the OFF mode. When pressure switch 342 is closed in response to operation of the engine under power, the base b of transistor 344 is driven during the OFF period; thereby completing a circuit through diode D5 to sink the voltage at collector c to $V_0$. Variable resistor 345 then determines the drain which adds to the existing drain of capacitor C1 through variable resistor 300. This permits adjustment of the metering rate under power.

FIG. 3-5 shows a circuit incorporating variable control of the metering rate, which may be done continuously or in steps by automatic means responsive to any of the functions already enumerated.

In FIG. 3-5, NPN transistor 355, the base b of which is driven during an OFF period of metering pump M from terminal S through resistor 356, activates a variable control circuit from terminal A through variable resistor 357, transistor 355 and resistor 358 to $V_0$. This circuit defines a maximum rate of metering as adjusted by variable resistor 357. This rate may be modified in response to an operating function by variable control resistor 360, which receives a positive voltage $V_{cc}$ from terminal 310 and determines the current passing through resistor 311 to junction 359 and through resistor 358. When this current is low, the voltage drop through resistor 358 to $V_0$ is at a minimum and the maximum metering rate set by variable resistor 357 prevails. When this current is high, current through resistor 358 increases its voltage drop and reduces the current through transistor 355. This slows the metering rate. Other devices of prior art capable of an equivalent output could be used in place of variable resistor 360. The circuit of FIG. 3-5 could also be replaced with another appropriate to the use of devices having other output characteristics.

The metering and blending unit

Unit 40 of FIG. 1 incorporates the metering pump M and blending pump B in a single package, serving both metering and blending functions. FIG. 4 is a section of unit 40, taken through metering pump M, and is shown for the purpose of description as a vertical section, base down,; although unit 40 may be mounted in a number of possible orientations. This section of metering pump M will also apply to blending pump B, which is equivalent except for dimensional differences and the addition of an orifice restriction in the magnetic plunger, which will be treated later. Each of these pumps operates; independently of the other.

Principal structural elements of unit 40 comprise a center section or body 41 and two end plates: inlet end plate 42 and outlet end plate 43. Bolts 401 or other fastening means pass through both end plates 42 and 43 and center section or body 41 to draw these elements together.

Inlet end plate 42 is bent at 420 and outlet end plate 43 at 430 to provide a base for mounting unit 40.

Inlet body 420 is secured to inlet end plate 42 by upsetting at 421; outlet body 430 is secured to outlet end plate 43 by upsetting at 431.

Inlet body 420 is provided with inlet port M1 of pump M or inlet port B1 of pump B, as in FIG. 1.

Barrel 44, which is thin-walled and of a non-magnetic material such as 18-8 stainless steel, is installed at the time of assembly of the principal structural elements of unit 40. It is positioned between a shoulder 434 in outlet body 430 and return impact ring 421 in inlet body 420, which bears against return buffer spring 422. Barrel 44 is sealed by O-ring 042 between inlet body 420 and ring 442; and by O-ring 043 between outlet body 430 and ring 443.

Frame 410 in body 41 receives an electronic circuit board 411, which carries power and control circuitry for pumps M and B and is potted or encapsulated in electrically insulating material. Power and control cable means enter through a port (not shown) which may optionally be in plate 42, plate 43 or body 41. Connections to be made within body 41 after assembly are accessible through port 402, normally closed by cover 403.

Drive coil 441 is carried on barrel 44 and maintains a dimensional separation between rings 442 and 443.

When coil 441 is energized, a magnetic circuit is set up through drive plunger 45 and surrounding stationary elements which include center section or body 41, end plates 42 and 43, inlet and outlet bodies 420 and 430, barrel 44 and rings 442 and 443. All of these elements are ferro-magnetic except for barrel 44. When drive plunger 45 is at rest as shown, a magnetic gap exists between the forward end 451 of this plunger and ring 443, which is closed by forward motion of the plunger under a driving force generated when the magnetic circuit is energized by coil 441. This is the forward stroke of pump M or pump B.

Mechanical elements of pump M or pump B are installed through outlet body 430. In addition to drive plunger 45, principal mechanical elements include drive spring 46, which transmits the forward force of plunger 45, pumping plunger 47, pumping cylinder or body 48 and return spring 478.

Pumping body 48 is secured in place by retainer 49 and sealed by O-ring 048. Fitted to the bore 480 of body 48 is pumping plunger 47. When driven forward, plunger 47 covers side ports 482 in body 48 at a travel determined by the relative position of these ports and the leading edge 470 of the full diameter of plunger 47. As the travel of pumping plunger 47 continues, most of the oil present in bore 480 is displaced and delivered from bore 480 by opening of check valve ball 485, which seats at the forward end 481 of bore 480. This valve is loaded by spring 486, held in place by spring retainer 487.

After completion of a forward stroke, pumping plunger 47 is returned to its initial position and oil may enter bore 480 through side ports 482 in preparation for the next stroke.

Retainer 49 serves several purposes: (1) to complete the assembly of pump M or pump B; (2) to seal at O-ring 049 against leakage of oil; (3) to align pumping body 48; (4) to provide a redundant ball check valve 492, with ring seat 491, spring 493 and spring retainer 494; and to provide outlet port M2 of pump M or B2 of pump B, as in FIG. 1.

Because of the importance of a precise fit between pumping plunger 47 and bore 480 of body 48, no part of the length of plunger 47 is made greater in diameter than the portion which fits bore 480. This permits the use of the most economical and effective production methods for insuring precision and finish of pumping plunger 47.

For durability, both pumping plunger 47 and body 48 may be of carburized or carbonitrided carbon steel or equivalent material.

Swaged or otherwise secured over end 473 of plunger 47 is plunger head 474, which serves several functions: (1) to receive the forward thrust of magnetic plunger 45, acting through drive spring 46 and spring end caps 461 and 462; (2) as a base for return spring 478, which is oppositely based against shoulder 488 on body 48; (3) as a stop of forward motion of pumping plunger 47, by striking against the end 489 of barrel 48; (4) to allow drive spring 46 to buffer the impact of magnetic plunger 45 when the forward motion of piston 47 is terminated by contact between plunger head 474 and end 489 of barrel 48; and (5), with drive spring 46 and spring end caps 461 and 462, to compensate for possible misalignment between pumping plunger 47 and the forward end 451 of magnetic plunger 45; thereby to avoid binding between magnetic plunger 45 and pumping plunger 47 when these parts are not completely in alignment.

The possible forward motion of plunger 47, as determined by the starting distance between pumping plunger head 474 and the end 489 of barrel 48, is made greater than the corresponding starting distance between the forward end 472 of plunger 47 and check valve ball 485; so that ball 485 will always be upset from its seat 481 by a small amount at the end of each forward stroke of plunger 47. The purposes of this are (1) to relieve the pressure of air within bore 480 in initial operation, when this pressure may not be sufficient to open valve ball 485; and (2), in normal operation, to clear foreign matter which might otherwise accumulate between ball 485 and seat 481.

Drive spring 46 must be stiff enough to transmit the forward motion of drive plunger 45 to pumping plunger 47; but must also act as a buffer to limit the force generated by the mass of drive plunger 45 in stopping after impact of pumping plunger head 473 upon the end 489 of barrel 48. A spring rate which will meet this requirement without substantial loss of motion of plunger 47 may be determined by trial.

When coil 441 is de-energized after a pumping stroke, spring 478 returns pumping plunger 47 and oil enters bore 480 through ports 482 in preparation for a succeeding stroke. Force transmitted through spring 46 also returns drive plunger 45, which is stopped by striking impact ring 421. This momentarily compresses return buffer spring 422, which thereafter restores ring 421 and drive plunger 45 to the rest positions shown.

As previously shown in FIG. 1, used oil from metering pump M is delivered after passing through filter 51 to junction fitting 54, which also receives fuel through line 740 from the engine fuel filter 71. Oil and fuel then enter pump B at B1 for primary blending of oil with a limited amount of fuel. The primary blend is thereafter delivered to the fuel system of an engine for mixing with additional fuel; in this case to filter 71.

The primary blending sequence

Figure 4B:
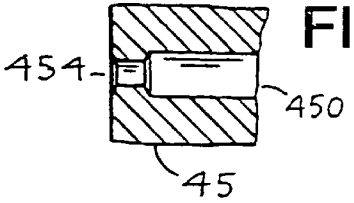
FIG. 4B shows in section a detail of a portion of the magnetic plunger as optionally used in blending pump B, in which an orifice restriction increases the velocity of reverse fluid flow from this plunger and its penetration into the incoming flow of oil and fuel during a forward stroke of the blending pump.

Primary blending of oil and fuel occurs in blending pump B, in a sequence of operations which include (1) first mixing of incoming oil and fuel in the entering space generally designated as 424, which begins at junction fitting 54 and continues during entry at port B1 and delivery to the space inside spring 422 and impact ring 421, augmented by rearward jetting action of oil and fuel delivered from passage 450 in plunger 45; preferably through a restrictive orifice 454 (FIG. 4B); (2) repetitive flow through plunger 45 in both directions during successive strokes, with absorption of heat from the driving coil 441; and (3) dispersion of oil into fuel by passage of the oil/fuel mixture through an opening created by movement of ball 485 away from its seat 481.

Jetting action from delivery of mixed oil and fuel into entering space 424 occurs during a forward stroke of plunger 45. The displacement per stroke of the magnetic plunger 45 is always greater than that of pumping plunger 47; so that only a minor portion of the fluid displacement of plunger 45 is taken up by plunger 47. The remainder of the fluid displaced by plunger 45 is forced to return through passage 450 and orifice 454 into the entering flow of oil and fuel into space 424. An orifice of small diameter delivers a jet of fluid at a velocity sufficient to create strong turbulence in space 424, which promotes mixing of oil and fuel.

Mixing also occurs by flow through passage 450 in plunger 45, during which a mixture of fuel and oil may be driven through plunger 45 repeatedly before passing on to the delivery pumping elements 47 and 48.

Following mixing of oil and fuel in the entering space 424 and by repetitive flow through drive plunger 45, blending is completed by dispersion of drops of oil which may remain in the oil/fuel mixture by delivery under pressure through an opening created by lifting of valve ball 485 from its seat 481. This pressure is generated by forward displacement of pumping plunger 47 into bore 480 of pumping barrel 48, and is opposed by the force of spring 486, which loads valve ball 485 and defines both the pressure of delivery and the area of opening.

Metering and blending volumes

The rate of used oil removal from the engine or other power equipment served is determined as a product of the volume of oil delivered on a single stroke of the metering pump M, which is fixed, and the rate of repetition of pump M, which can be varied to control the rate of removal. The volume delivered per stroke is usually greater in the blending pump than in the metering pump and the rate of repetition of the blending pump is normally higher than the highest rate of the metering pump; so that the overall rate of delivery of the blending pump is greater. This is necessary because the blending pump must not only pass the oil received from the metering pump, but must add to this the volume of fuel required for blending. Experience with these systems on large engines indicates that oil concentration in the primary blend may be as much as 25 percent and possibly higher, without impairing the ability of this blend to mix with more fuel to create a final blend for use in an engine.

The average concentration of oil in the final blend over a given operating period is determinable from the total removal of used oil from the equipment served and total fuel consumption of the engine over the same period, and is independent of the proportion of fuel which passes through the primary blending process.

We claim:

1. A system for maintaining a supply of lubricating oil in the sump of a lubricated mechanism at a predetermined level, while simultaneously continuously removing metered amounts of used oil from said sump when the level of said oil in said sump is above said predetermined level for disposal during operation of the mechanism, said system comprising:

a supply tank to hold reserve lubricating oil for said mechanism;

a conduit between said sump and said supply tank, said conduit having an intake port into said sump at said predetermined level, said level being selected such that, below it there remains a volume of lubricating oil in said sump that is sufficient to protect the mechanism while in operation;

pump means in said conduit adapted to draw fluid from said sump at said predetermined level and deliver it to said supply tank, said fluid being liquid lubricating oil when said inlet port is submerged, air when said inlet port is not submerged, or mixtures of oil and air during intermediate conditions, whereby said pump means is unable to draw liquid lubricating oil from said sump from below said predetermined level; and separator means receiving a portion of liquid from said conduit, thereby removing said portion from the system which system comprises said supply tank, pump means, sump and conduit.

2. A system according to claim 1 in which accumulator means receives lubricating oil from said separator means and stores some of said separated oil for disposal in times during operation of the mechanism when no lubricating oil is present in said conduit at said separator.

3. A system according to claim 1 in which metering means draws lubricating oil from said separator means and mixes it with a metered amount of engine fuel to form a blend of lubricating oil and fuel, and means for adding said blend to additional engine fuel for consumption by a fuel-consuming mechanism.

4. A system according to claim 3 in which accumulator means receives lubricating oil from said separator means and stores some of said separated oil for disposal in times during engine operation when no lubricating oil is present in said conduit at said separator.

5. A system according to claim 1 in which said pump means operates continuously, and in which said metering means adds fuel to said portion of the lubricating oil in amounts respective to a desired blend of lubricating oil and fuel.

6. A system according to claim 1 in which said portion of the lubricating oil is added to fuel being supplied to the mechanism.

* * * * *